United States Patent [19]

Behrens

[11] 4,302,799

[45] Nov. 24, 1981

[54] BREAKAWAY REUSEABLE RUNWAY MARKER LAMP FOR AIRPORTS

[76] Inventor: Walter R. Behrens, R.R. 6, Country Club Rd., Minot, N. Dak. 58701

[21] Appl. No.: 76,218

[22] Filed: Sep. 17, 1979

[51] Int. Cl.[3] ..... H01R 33/00

[52] U.S. Cl. ..... 362/226; 362/62; 362/145; 362/367

[58] Field of Search ..... 362/62, 145, 226, 369, 362/390, 431, 152

[56] References Cited

U.S. PATENT DOCUMENTS

| | | | |
|---|---|---|---|
| 1,886,004 | 11/1932 | Geyser | 362/390 X |
| 2,424,688 | 7/1947 | Grimes | 362/226 |
| 2,715,214 | 8/1955 | Appleton | 362/369 X |
| 3,008,742 | 11/1961 | Goldstein | 362/431 X |
| 3,364,635 | 1/1968 | Guggemos | 362/431 X |
| 3,755,977 | 9/1973 | Lewis | 362/431 X |
| 3,805,055 | 4/1974 | Cassey | 362/431 X |
| 4,091,442 | 5/1978 | Markey | 362/390 X |
| 4,104,711 | 8/1978 | Carter | 362/390 X |
| 4,161,723 | 7/1979 | De Vittori | 362/431 X |

*Primary Examiner*—Peter A. Nelson

[57] ABSTRACT

A breakaway reuseable marker lamp suitable for airport runway usage utilizes a base which is threaded into existing electrical junction boxes along the runway and an upright post which is frictionally releaseably retained in a socket of the base for easy breakaway in response to impact by an aircraft or other vehicle and easily manually reinserted. The post includes inner and outer telescoping sections so as to vary the height of the post for changing local requirements. To avoid damage to wiring extending between base and post, the lower end of the post, which fits within the socket, has a beveled rim. Use of the rim helps prevent cutting or stripping of the electrical wiring which bears against the rim during separation of post and base.

7 Claims, 5 Drawing Figures

BREAKAWAY REUSEABLE RUNWAY MARKER LAMP FOR AIRPORTS

BACKGROUND OF THE INVENTION

This invention relates to the field of airport runway marker lamps and comprises an improved structure which provides a breakaway lamp post which is capable of separation from its base without permanent damage to the post and which consequently may be easily and rapidly re-erected by maintenance personnel.

Maintenance requirements of runway marker lamps are a continuous source of work for airport personnel. Due to the importance of reliable lighting in nightime aircraft landing and movement, these lamps should be operating at all times and down time must be minimized.

Traditionally, such lamps have been mounted on upright metal posts which have a threaded lower end which screws directly into a ground-mounted electrical junction box. The metal posts are deeply scored adjacent the threaded lower end so that, if the post is struck by an aircraft or other vehicle, the post will break or snap along the scoring. Such breakaway feature is recognized as an important safety requirement, and the described construction has been standard equipment at airstrips for many years.

While the scored metal posts are reliable and long lasting, they are quite difficult to replace when breakaway occurs during collision, and marker lamps are struck and broken with considerable frequency. Breakage is particularly likely during inclement weather, as for example when aircraft may be landing on slippery runways or under lateral wind conditions, causing sideward movement of the aircraft and resulting collision between the lamp and the aircraft body. Under such conditions, one or more lamps may be snapped off during landing. In the northern climates where snow accumulation is a constant problem during winter seasons, snowplows also strike and break the runway lamps. With the presently used scored metal posts, breakage of a post results in the lower threaded end of the post being lodged within the electrical junction box and requires that the lower end of the post be chiseled out. Such removal requires a workman to laboriously chip the broken threaded end from the socket using a cold chisel and can be a tedious, time-consuming operation, particularly when the broken end may be rusted or corroded within the threads of the electrical junction box. Such repair is still more onerous when done in sub-zero temperatures and frigid wind chill conditions on the open runway.

Still another problem which can arise during breakaway with the now used, scored metal post is that the fairly sharp fractured rim of the post which remains along the scoring after breakaway is sharp and jagged enough to strip or cut the electrical wiring passing from the electrical junction box upward through the post and, accordingly, wiring damage may also occur during breakaway and can require further time and effort for repair.

Another shortcoming of the presently used marker lamps is that they are a fixed height and cannot be varied. In many parts of the world where snowfalls accumulate, it is desirable that posts be able to be raised so as to be visable over the snow. However, posts placed so high as to extend over snow accumulations are too high to easily accommodate grass mowing equipment during the summer months. It would be desirable to be able to raise the post level during the snowy months and to easily lower the level during the summer so that sickle bar mowers may work the grassy areas and still be able to elevate their sickle bars to pass over the posts. The problem is solved by the present invention.

Accordingly, with the problems of maintaining the known airport marker lamp systems, it is desirable to provide an improved breakaway marker lamp which is reuseable, reliable, resistant to breakage, and rapidly and inexpensively repaired. The present invention accomplishes these objectives.

SUMMARY OF THE INVENTION

A reuseable, breakaway runway marker lamp utilizes a base threadably connectable to existing marker lamp junction boxes, an upright post member, and a quickly releasable coupling device for joining the base and the post member but capable of rapid separation when the post is impacted by an aircraft or other vehicle. The post member carries a conventional marker lamp at the top thereof and includes a pair of telescoping coaxial sections which slide relative to one another so as to vary the length of the post to allow for various height requirements. Detent means are provided between the sections to retain the sections in desired extended positions relative to one another.

The base is formed of elastically deformable plastic-like material such as polyvinylchloride and is provided with a male thread which may be threaded into any existing electrical junction box positioned along the runway. The base also includes an upright support member which has an interior channel passing therethrough and communicating with the junction box for passage of electrical wiring from the box.

The post member is of generally circular cross section and may be provided at its lower end with a bevel along the inner periphery of its rim so that, during breakaway from the coupling device, electrical wiring passing through the upright member is not stripped or cut by rubbing against the rim.

The quickly releasable coupling device may be a part of either the upright or post members and is preferably a female coupling device capable of receiving the other of the members within and to frictionally retain it unless struck by an aircraft or other vehicle. Under impact, the coupling device and the inserted member elastically deform and the inserted member pops out of the coupling device and remains out until manually reinserted by an operator.

These and other objects and advantages of my invention will appear more fully from the following description made in conjunction with the accompanying drawings wherein like reference characters refer to the same or similar parts throughout the several views.

DESCRIPTION OF THE PREFERRED EMBODIMENTS

Figure 1:
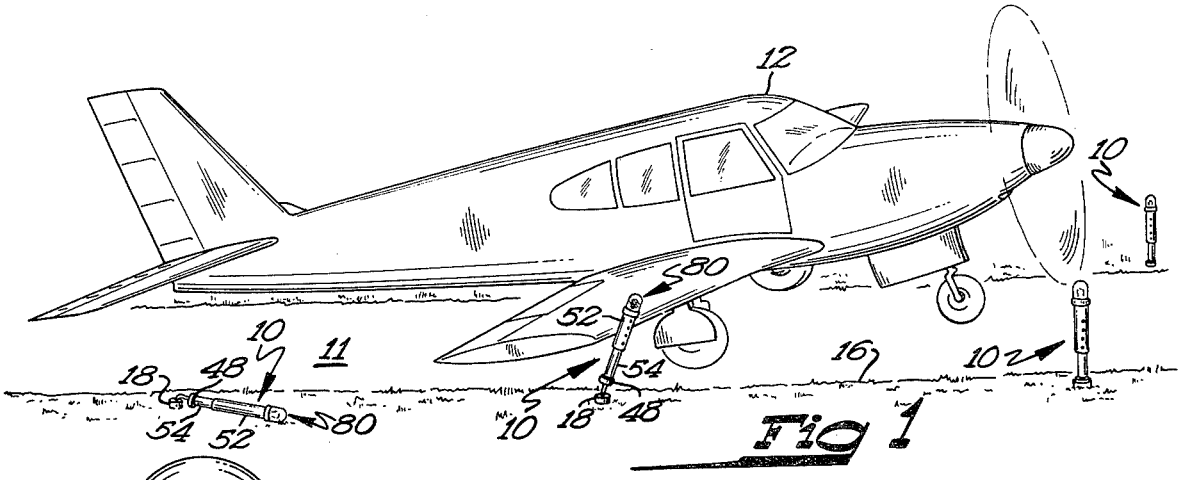
FIG. 1 is a perspective drawing of a first embodiment of the breakaway marker lamp in use along an airport runway.

Referring now to FIG. 1 of the drawings, a first embodiment of a breakaway, reuseable marker lamp 10, is shown positioned along and adjacent an airport runway 11 so as to provide illumination for landings and take-offs by an aircraft 12.

Each of the shown marker lamps 10 of FIG. 1, which are substantially identical to one another, is normally supported by and threaded into a standard, ground-engaging, fixed electrical junction box 14 (FIG. 2) of the type normally used along airport runways. While such junction boxes vary somewhat in physical size and shape, they commonly are positioned beneath the ground level 16 and are provided with a frusto-conical cap 18 which extends above ground level and has a round threaded aperature 20 to which a marker lamp 10 may be mounted.

While the underground junction box 14 will not be described in great detail, it should be understood that such boxes are normally provided with a pair of sealed conduit connections 22 and 24 by which a pair of electrical conductors 26 and 28 pass through the junction box and are electrically connected in electrical parallel with wires 30 and 32 to energize the bulb 82 of the marker lamp as will be described further hereafter.

Figure 2:
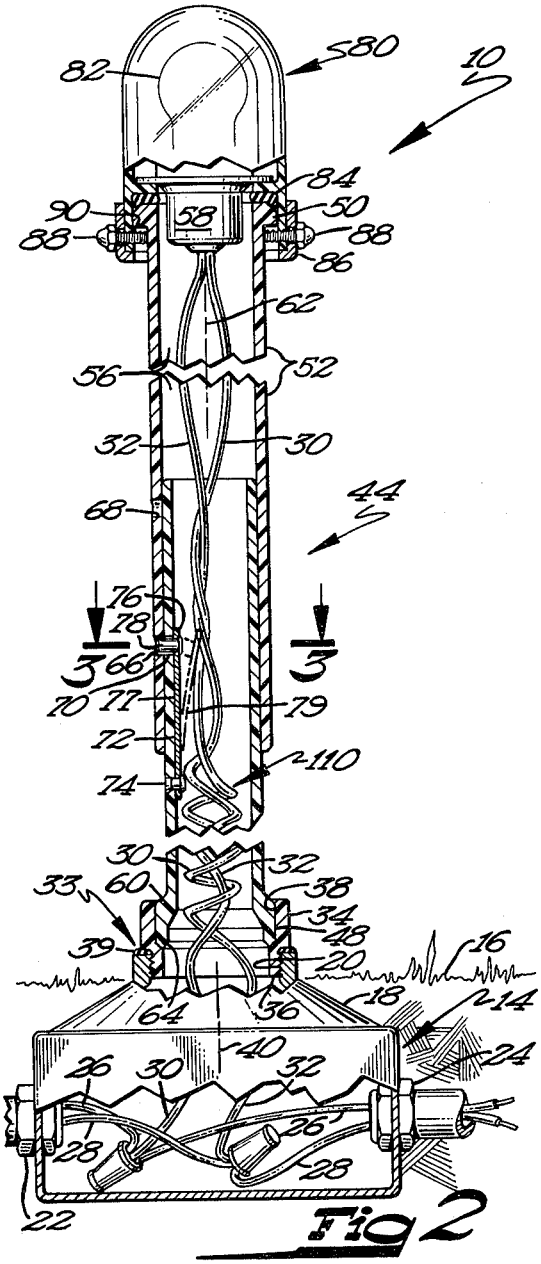
FIG. 2 is a side elevation view of the marker lamp of FIG. 1 taken partly in cross section.
Figure 3:
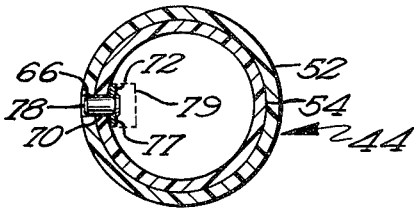
FIG. 3 is a cross sectional top view of the telescoping post of FIG. 2 taken along cutting plane 3—3.
Figure 4:
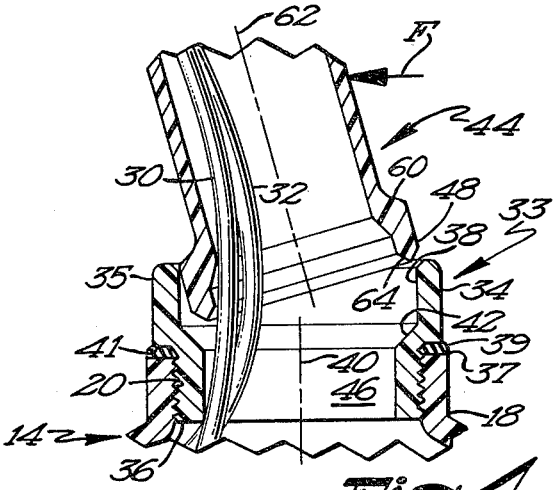
FIG. 4 is a cross sectional side elevation view of a portion of the marker lamp of FIG. 2 showing the post and coupling device during breakaway.

As best shown in FIGS. 2 and 4, a base 33 has an upright support member 34 of generally circular cross section and a threaded male portion 36 which threadably engages the threads 20 of the electrical box cap 18. The upright support member 34 has a generally circular cross section socket 38 whose central axis is coincident with the longitudinal central axis 40 of upright support member 34.

The socket 38 has an annular, inwardly extending shoulder 42 to limit downward penetration of the post member 44.

The support member 34 has the outer periphery 35 of the socket 38 extended outwardly to define a surface 41 which overlaps the rim 37 of the cap 18. A gasket 39 may be interposed between the rim 37 and surface 41 to further inhibit leakage when member 34 is tightly screwed into cap 18.

The socket 38 of the upright support member 34 provides a quickly releasable female coupling device which permits the post member 44 to be manually inserted within the coupling device by an operator and to be frictionally, removably retained within the coupling device.

The socket 38 and preferably the entire support member 34 is formed of a plastic-like material which is substantially elastically deformable such that if the member is deformed by moderate impact, the material can absorb such deformation and return substantially to its original configuration without fracture or breakage. Material such as polyvinylchloride has proved acceptable for the support member 34.

The upright post member 44 has a lower end 48 and upper end 50. The post member 44 may be integral or may take the form of a pair of telescoping outer and inner sections 52 and 54, respectively, which are slideably movable relative to one another to extend or reduce the length of the post member. In either structure, the interior of the generally circular cross section post member contains a hollow, longitudinal channel 56 with a central axis 62 through which the wires 30 and 32 may extend upwardly from the support member 34 to the light bulb socket 58.

The lower end 48 of the post member is provided with a shoulder 60 of generally circular configuration and having an outer periphery adapted to fit closely within the socket 38 and to frictionally engage the socket so as to retain the post member within the socket with the longitudinal axis 40 of the upright support member 34 when the post member is in its upright inserted orientation within the socket 38 as shown in FIG. 2.

The lower most edge of shoulder 60 has its open ended rim provided with an annular bevel 64 along the inner periphery of the rim so that when the post member is struck and forcibly dislodged from the socket, the lower end 48 will not cut, strip, or destructively rub the electrical wires 30 and 32 during breakaway, as will be further described hereafter.

The outer telescoping section 52 of the post member is provided with a plurality of vertically aligned apertures such as 66 and 68 therealong in order to retain the outer section in any of a plurality of predetermined positions relative to the inner section 54 in order that the overall post height may be maintained at the desired level. While two such apertures are here shown, it should be understood that any practical number of apertures may be provided to provide a sufficient range of adjustment.

The inner telescoping section 54 has an aperture 70 which is alignable with the apertures 66 or 68 already described. An elongated leaf spring 72 has one of its ends attached to the inner telescoping section 54 by means of a pop rivet 74 or other appropriate fastener known to the art, permitting the free end 76 to be movable toward or away from the section 54 between latching position 77 and retracted position 79. The upper end 76 carries a peg 78 firmly fixed to the spring 72 and which is normally biased by the leaf spring 72 to enter and pass through the aperture 70 so as to engage an aperture 66 or 68 of the outer section 52 to retain the two telescoping post sections in a predetermined orientation relative to one another. If desired, an indexing line may be provided on the lower telescoping section 54 so that an operator may align the aperture 66 or 68 such indexing line to more readily permit insertion of the peg 78 into the apertures 66 or 68. Accordingly, the leaf spring 72 and peg 78 fixed to the section 54 and the apertures 70, 66 and 68 collectively comprise a detent means useable with the invention to control the positioning of the sections 52 and 54.

The post member 44 should be formed of a plastic-like material such as polyvinylchloride which is capable of reasonable elastic deformation when impacted so that the lower end 48 of the post member will pop out of the socket 38 when struck by aircraft, snowplows or the like.

A lamp housing 80, including bulb 82 and bulb socket 58 is carried at the upper end 50 of the post member. The lamp housing is provided with a gasket 84 and has a downwardly extending flange 86 constructed and arranged so that retention screws 88 extend beneath the lip 90 of the post member, thus securely retaining the lamp housing 80 to the post member.

In operation, the marker lamp 10 must first be installed along the airport runway, and this installation is accomplished by screwing the threaded portion 36 of the base 33 into the threaded aperture 20 of the cap 18 of each ground-engaging electrical junction box 14 along the runway 11. The electrical wiring from the lamp housing 80 which extends downwardly through interior 56 and through channel 46 is contemporaneously operably connected to the wiring within the electrical box 14, as is well known to the art. Some extra wire length or slack is retained within the interior 56 as shown at 110 to allow some freedom of movement of post 44 during breakaway. The installer, or operator, next physically presses the lower end 48 of the post member 44 into the coupling device or socket 38 using light manual force and the frictional engagement between the socket 38 and the lower end 48 retains the post member in an upright orientation with axes 40 and 62 coincident until struck and dislodged by an aircraft or other vehicle.

The operator next aligns the aperture 70 with aperture 66 or 68, depending upon the desired height of the lamp, and the peg 78 is urged radially outwardly through aperture 70 into the aperture 66 or 68 by the biasing force of the spring 72, thus retaining the outer section 52 in one of a plurality of alternate, vertical positions. By manually pushing the peg 78 radially inwardly and out of the aperture 66 or 68 the outer section 52 can be adjusted upwardly or downwardly by an operator to an alternative position.

When the post member 44 is struck by an aircraft 12 or other vehicle, applying a laterally directed force F (FIG. 4), the force causes elastic deformation of the post member 44 and of the socket 38 causing the lower end 48 of the post member to pop out of the socket 38 as shown in FIG. 4. As the post member 44 pulls free of the socket, the post member returns elastically to its original configuration as the force is removed, and during breakaway the electrical wires 30 and 32 limit the travel of the post member and are protected from stripping, cutting or destructive rubbing by the annular bevel 64 at the lower end 48 of the post member.

The frictional engagement between post member 44 and socket 38 which permits easy, manual insertion of the post member by an operator, assures that when the post member is struck by an aircraft or other vehicle, the post member pops out of the socket without damage to the vehicle. The operator may thereafter easily, physically reinsert the post member in the socket and quickly restore the marker lamp to full operating condition thus speeding repair, minimizing down time, cutting labor repair expense and eliminating long exposure to adverse weather.

Figure 5:
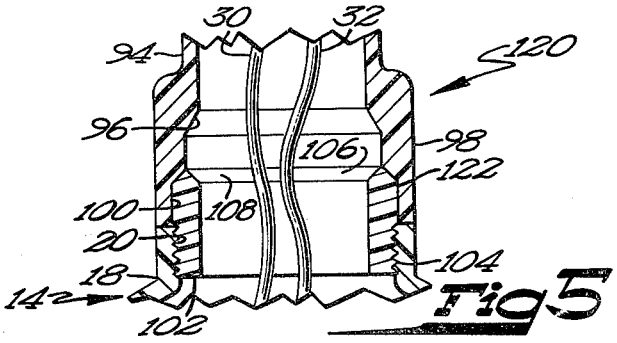
FIG. 5 is a cross sectional side elevation view of a portion of a marker lamp showing a second embodiment of the marker lamp invention.

A second embodiment 120 of the invention is shown in FIG. 5 in which identical elements of the marker lamp already described carry identical reference numbers to those used earlier. Referring again to FIG. 5, a post member 94 is identical to the post member 44 already described except that the lower end 96 of the post member 94 has a coupling device 98 fixed thereto or carried thereon which is here shown as a socket 100 which is circular in cross section and in all other respects like the socket 38 described earlier.

The base of the embodiment 120 of FIG. 5 is designated as 102 and is a cylindrical sleeve which has an upright member 122 and a threaded portion 104 at its lower end which threadably engages the thread 20 of the cap 18 of electrical junction box 14. The rim 106 of the upright member 122 has an annular bevel 108 so as to avoid cutting or stripping of the wires 30 and 32 during breakaway.

The post member 94 is mounted to the upright member 122 by an operator pressing the socket 100 downwardly over the upright member 122 to produce a frictional engagement between them, such frictional retention being adequate to keep the post member 94 in an upright position unless struck by an aircraft or other vehicle.

Accordingly, it is seen that the present invention provides a highly reliable, easily manufactured and inexpensive solution to the present problems of maintenance and repair to aircraft marker lamps. It will thus be appreciated that the described problems of formerly known marker lamps have been substantially eliminated by the described invention. An operator need no longer spend long time periods in inclement weather to laboriously chip away a fractured metal, threaded post from an electrical junction box and to then completely rewire a new post and erect it. All such labor aside from picking up the downed post and reinserting it in the socket 38 is substantially eliminated by the invention, and likelihood of damage to aircraft from such collisions is greatly reduced.

While the preferred embodiments of the present invention have been described, it should be understood that various changes, adaptations and modifications may be made therein without departing from the spirit of the invention and the scope of the appended claims.

I claim:

1. A breakaway, reuseable marker lamp for an airport runway, mountable to a fixed ground engaging electrical junction box containing electrical wiring and located adjacent the runway and dislodgeable relative to the box by aircraft impact with minimal harm to aircraft, marker lamp and electrical wiring comprising:

a base rigidly mountable to the electrical junction box for retention by the box, and further including an upright support member extending upwardly relative to the box and having an interior channel communicating with the box for passage of electrical wiring from the box;

an upright post member having upper and lower ends and having a hollow interior extending between said upper and lower ends for passage of the electrical wiring from said support member of said base to the upper end of said post;

a quickly releaseable coupling device on one of said members to permit the other of said members to be inserted within said coupling device and to be frictionally, removably retained within said coupling device, said device being formed of a breakage resistant, elastically deformable, plastic material which is elastically deformable during impact so as to permit dislodgment of the other of said members from said device and separation of said post member relative to said support member when said post member is struck, the structural integrity of said coupling device and members remaining intact after impact; and a lamp housing fixed to said upper end of said post member and operably connectable to the electrical wiring.

2. A breakaway, reuseable, runway marker lamp for an airport runway mountable to a fixed ground engaging electrical junction box containing electrical wiring and located adjacent the runway and dislodgable relative to the box by aircraft impact with minimal harm to the aircraft, lamp, and electrical wiring comprising:

a base mountable to the electrical box for retention by said box and having a hollow channel therethrough for passage of electrical wiring from the box and further including a hollow, cylindrical upright support member having an upright central axis;

an upright post member having a generally circular cross-section and a central axis, said member having upper and lower ends and a hollow interior to receive the electrical wiring from said support member, said longitudinal central axis of said post being coaxial with the axis of said support member;

a female coupling device on one of said members to permit the other of said members to be frictionally inserted within said female coupling device and to be frictionally retained within said device, said coupling device being formed of plastic material which is deformable under impact so that in response to forces applied at generally right angles to said post member, said female coupling device is dislodged relative to said other of said members;

said support member being of generally circular cross-section with a rim whose inner periphery is beveled so as to eliminate cutting and stripping of electrical wires contacting said inner periphery of said rim during breakaway; and, a lamp fixed to the upper end of said post and connectable to said electrical wiring.

3. A breakaway, reuseable marker lamp for an airport runway, mountable to a fixed ground engaging electrical junction box containing electrical wiring and located adjacent the runway and dislodgeable relative to the box by aircraft impact with minimal harm to aircraft, marker lamp and electrical wiring comprising:

a base rigidly mountable to the electrical junction box for retention by the box, and further including an upright support member extending upwardly relative to the box and having an interior channel communicating with the box for passage of electrical wiring from the box;

an upright post member having upper and lower ends and having a hollow interior extending between said upper and lower ends for passage of the electrical wiring from said support member of said base to the upper end of said post;

a quickly releaseable coupling device on one of said members to permit the other of said members to be inserted within said coupling device and to be frictionally, removably retained within said coupling device, said device being formed of a breakage resistant, elastically deformable, plastic material which is elastically deformable during impact so as to permit dislodgment of the other of said members from said device and separation of said post member relative to said support member when said post member is struck, the structural integrity of said coupling device and members remaining intact after impact;

a lamp housing fixed to said upper end of said post member and operably connectable to the electrical wiring; and, said other of said members having an open-ended rim receivable within said coupling device and said rim having an annular bevel along its inner periphery so as to inhibit destructive rubbing and stripping of the electrical wiring within said members during breakaway.

4. A breakaway, reuseable marker lamp for an airport runway, mountable to a fixed ground engaging electrical junction box containing electrical wiring and located adjacent the runway and dislodgeable relative to the box by aircraft impact with minimal harm to aircraft, marker lamp and electrical wiring comprising:

a base rigidly mountable to the electrical junction box for retention by the box, and further including an upright support member extending upwardly relative to the box and having an interior channel communicating with the box for passage of electrical wiring from the box;

an upright post member having upper and lower ends and having a hollow interior extending between said upper and lower ends for passage of the electrical wiring from said support member of said base to the upper end of said post;

a quickly releaseable coupling device on one of said members to permit the other of said members to be inserted within said coupling device and to be frictionally, removably retained within said coupling device, said device being formed of a breakage resistant, elastically deformable, plastic material which is elastically deformable during impact so as to permit dislodgment of the other of said members from said device and separation of said post member relative to said support member when said post member is struck, the structural integrity of said coupling device and members remaining intact after impact;

a lamp housing fixed to said upper end of said post member and operably connectable to the electrical wiring; and, said post member, base, and coupling device being formed of polyvinylchloride.

5. The marker lamp of claim 1 wherein said post member includes inner and outer substantially coaxial, telescoping sections, slidable relative to one another to vary the length of said post member and further includes detent means engageable between said sections to retain said sections in a predetermined orientation relative to one another, said detent means including an aperture in said inner section and a plurality of apertures in said outer section alignable with said aperture of said inner section, and said detent means further including a leaf spring within said inner section and carrying a peg thereon, said peg being slideably movable through said aperture in said inner section to selectively engage an aperture of said outer section in response to spring tension of said spring.

6. The marker lamp of claim 1 wherein said coupling device is formed of polyvinylchloride.

7. The marker lamp of claim 4 wherein said coupling device is on said upright support member of said base.

* * * * *